US012331464B2

(12) United States Patent
Seidler et al.

(10) Patent No.: US 12,331,464 B2
(45) Date of Patent: Jun. 17, 2025

(54) ELECTRICALLY CONDUCTIVE PAPER STRUCTURE, METHOD FOR MANUFACTURING SAME AND USE

(71) Applicant: GIESECKE+DEVRIENT CURRENCY TECHNOLOGY GMBH, Munich (DE)

(72) Inventors: Rudolf Seidler, Gmund (DE); Daniel Lenssen, Munich (DE); Maik Rudolf Johann Scherer, Grainau (DE); Christoph Hunger, Hausham (DE); Erwin Bacher, Hausham (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 166 days.

(21) Appl. No.: 17/608,688

(22) PCT Filed: Apr. 27, 2020

(86) PCT No.: PCT/EP2020/025191
§ 371 (c)(1),
(2) Date: Nov. 3, 2021

(87) PCT Pub. No.: WO2020/224800
PCT Pub. Date: Nov. 12, 2020

(65) Prior Publication Data

US 2022/0213651 A1 Jul. 7, 2022

(30) Foreign Application Priority Data

May 9, 2019 (DE) ..... 10 2019 003 281.0

(51) Int. Cl.
*D21H 13/48* (2006.01)
*D21H 15/06* (2006.01)
(Continued)

(52) U.S. Cl.
CPC ..... *D21H 13/48* (2013.01); *D21H 15/06* (2013.01); *D21H 17/67* (2013.01); *D21H 21/14* (2013.01); *D21H 27/34* (2013.01)

(58) Field of Classification Search
CPC ..... D21H 13/48; D21H 15/06; D21H 17/67; D21H 21/14; D21H 27/34
See application file for complete search history.

(56) References Cited

U.S. PATENT DOCUMENTS 4,761,205 A * 8/1988 Crane ..... G07D 7/026 162/134
5,783,275 A 7/1998 Mück et al.
(Continued)

FOREIGN PATENT DOCUMENTS

CN 101636005 A * 1/2010 ..... B29C 48/022
CN 108882411 A * 11/2018 ..... D03D 15/00
(Continued)

OTHER PUBLICATIONS

CN-101636005-A Translation (Year: 2010).*
(Continued)

*Primary Examiner* — Jacob T Minskey
*Assistant Examiner* — Stephen M Russell
(74) *Attorney, Agent, or Firm* — Workman Nydegger

(57) ABSTRACT

Electroconductive paper structure with cellulosic fibrous materials and electroconductive fibers, wherein the electroconductive paper structure has embedded therein a continuous, electroconductive thread for contacting the electroconductive paper structure from one end to the opposite end of the paper structure.

16 Claims, 4 Drawing Sheets

(51) Int. Cl.

| | |
|---|---|
| ***D21H 17/67*** | (2006.01) |
| ***D21H 21/14*** | (2006.01) |
| ***D21H 27/34*** | (2006.01) |

(56) References Cited

U.S. PATENT DOCUMENTS

| | | | | |
|---|---|---|---|---|
| 2002/0085968 | A1* | 7/2002 | Smalley | D01F 9/12<br>422/600 |
| 2010/0206504 | A1* | 8/2010 | Akiyama | D21H 21/14<br>977/734 |
| 2015/0167205 | A1* | 6/2015 | Cooper | D02G 3/36<br>57/295 |
| 2019/0297676 | A1* | 9/2019 | Ito | H05B 3/36 |

FOREIGN PATENT DOCUMENTS

| | | | | |
|---|---|---|---|---|
| EP | 0059056 | A1 | 9/1982 | |
| EP | 0229645 | A1 | 7/1987 | |
| EP | 0279880 | A1 | 8/1988 | |
| EP | 0492407 | A1 | 7/1992 | |
| EP | 0625431 | A1 | 11/1994 | |
| EP | 753623 | A2 * | 1/1997 | B41M 3/14 |
| EP | 2848734 | A1 | 3/2015 | |
| EP | 2770104 | B1 | 5/2016 | |

OTHER PUBLICATIONS

CN-108882411-A Translation (Year: 2018).*
International Search Report and Written Opinion from PCT Application No. PCT/EP2020/025191, Sep. 3, 2020.

* cited by examiner

ELECTRICALLY CONDUCTIVE PAPER STRUCTURE, METHOD FOR MANUFACTURING SAME AND USE

BACKGROUND

The invention relates to an electroconductive paper structure, a method for manufacturing the same and the use of the electroconductive paper structure.

Electroconductive paper structures based e.g. on cellulosic fibrous materials and carbon fibers are known in the prior art, see e.g. EP 2 770 104 B1. It is thus basically known to equip areal paper substrates with conductive fibers, in particular metal fibers or graphitized carbon fibers, or other materials providing conductivity, e.g. carbon nanotubes, such that the electric current flows through the areal paper substrate. Depending on the specific resistance present, the paper substrate can be utilized for different purposes, e.g. as a heating element, as an element for electromagnetic shielding or as an element for signal detection.

The electroconductive paper structure can be contacted in various ways in order to conduct electric current through the paper structure starting from the contacts. Commonly used are e.g. adhesive contacts that are applied to parts of the surface of the electroconductive paper structure. The disadvantage here is the contacting by rather poorly conductive organic adhesive layers, which are also susceptible to detachment under mechanical stress. Furthermore, it is often desirable to connect the electroconductive paper structure with so-called crimp contacts. This is very difficult to implement by means of adhesively bonded elements.

The present invention is thus based on the object of providing an electroconductive paper structure with improved contacting.

SUMMARY OF THE INVENTION 1. (First aspect of the invention) An electroconductive paper structure with cellulosic fibrous materials and electroconductive fibers, characterized in that the electroconductive paper structure has embedded therein a continuous, electroconductive thread for contacting the electroconductive paper structure from one end to the opposite end of the paper structure.

2. (Preferred configuration) The electroconductive paper structure according to clause 1, wherein the electroconductive paper structure has embedded therein a plurality of continuous, electroconductive threads for contacting the electroconductive paper structure from one end to the opposite end of the paper structure, wherein the plurality preferably assumes a value in the region of two to eight, more preferably a value in the region of two to six, and particularly preferably the value two.

3. (Preferred configuration) The electroconductive paper structure according to clause 1 or 2, wherein the electroconductive fibers are metallic fibers, in particular metallic shortcut fibers with a preferred fiber length in a region of 3 mm to 12 mm, and/or carbon fibers.

4. (Preferred configuration) The electroconductive paper structure according to any of clauses 1 to 3, wherein the electroconductive paper structure contains additional electroconductive materials, in particular carbon particles and/or carbon nanotubes 5. (Preferred configuration) The electroconductive paper structure according to any of clauses 1 to 4, wherein the electroconductive thread for contacting the electroconductive paper structure is a metal wire, a metal thread, a metal band, a thread based on a carrier substrate such as a plastic foil and coated with a metal, a laminate of (plastic) foils and metal foils, a metal braiding, a plait braiding, a knitted fabric or a tinsel wire.

6. (Preferred configuration) The electroconductive paper structure according to any of clauses 1 to 5, wherein the paper structure is based on a single paper ply in which the electroconductive thread is embedded for contacting the electroconductive paper structure.

7. (Preferred configuration) The electroconductive paper structure according to any of clauses 1 to 5, wherein the paper structure is based on two separate paper plies between which the electroconductive thread is arranged for contacting the electroconductive paper structure.

8. (Preferred configuration) The electroconductive paper structure according to any of clauses 1 to 7, wherein

- the electroconductive thread for contacting the electroconductive paper structure is completely embedded in the paper structure so that the thread is not visible to the viewer, neither from the front nor from the back; or
- the thread is embedded in the paper structure such that the thread is present in the paper structure in a manner freely accessible on one side; or
- the thread is embedded in the paper structure such that the thread is partially exposed on its surface at least at one place of the paper structure.

9. (Preferred configuration) The electroconductive paper structure according to any of clauses 1 to 8, wherein the electroconductive paper structure additionally has chemical additives and residual moisture.

10. (Preferred configuration) The electroconductive paper structure according to any of clauses 1 to 9, wherein the electroconductive paper structure is additionally printed with a conductive pattern of conductor paths.

11. (Preferred configuration) The electroconductive paper structure according to clause 10, wherein the electroconductive paper structure has two or more continuous, electroconductive threads embedded therein for contacting the electroconductive paper structure from one end to the opposite end of the paper structure, wherein the threads are each embedded in the paper structure such that each thread is partially exposed on its surface at several places of the paper structure, wherein the electroconductive paper structure is printed with the conductive pattern of conductive paths such that the contacting of the conductive pattern to the threads embedded in the paper structure is effected via the places at which the threads are partially exposed.

12. (Second aspect of the invention) A method for manufacturing an electroconductive paper structure according to any of clauses 1 to 11, comprising:

- providing a stock suspension made of cellulosic fibrous material and water;
- adding at least one chemical additive, where applicable;
- adding electroconductive fibers;
- introducing at least one continuous, electroconductive thread into the stock suspension located in a cylinder paper machine, wherein the thread is brought toward the cylinder sieve such that during the sheet formation (or during the formation of the paper web) an embedding of the thread into the fiber construction is effected.

13. (Preferred configuration) The method according to clause 12, wherein the paper structure is formed such that it is composed of two separate paper plies and the thread is arranged between these paper plies.

14. (Third aspect of the invention) A use of the electroconductive paper structure according to any of clauses 1 to 11 as a heating element, as an element for electromagnetic shielding or as an element for signal detection.

15. (Fourth aspect of the invention) An electroconductive paper structure consisting substantially of cellulosic fibrous materials, characterized in that the paper structure has embedded therein a continuous, electroconductive thread for contacting the paper structure from one end to the opposite end of the paper structure, wherein the thread is embedded in the paper structure such that the thread is partially exposed on its surface at several places of the paper structure, wherein the paper structure is printed with a conductive pattern of conductive paths such that the contacting of the conductive pattern to the thread embedded in the paper structure is effected via the places at which the thread is partially exposed.

16. (Preferred configuration) The electroconductive paper structure according to clause 15, wherein the paper structure has embedded therein two or more continuous, electroconductive threads for contacting the paper structure from one end to the opposite end of the paper structure, wherein the threads are embedded in the paper structure such that each thread is partially exposed at its surface at several places of the paper structure, wherein the paper structure is printed with a conductive pattern of conductive paths such that the contacting of the conductive pattern to the threads embedded in the paper structure is effected via the places at which the threads are partially exposed.

BRIEF DESCRIPTION OF THE DRAWINGS

Further embodiments as well as advantages of the invention will be explained hereinafter with reference to the Figures, in whose representation a rendition that is true to scale and to proportion has been dispensed with in order to increase the clearness.

There are shown.

DETAILED DESCRIPTION OF THE PREFERRED EMBODIMENTS

Figure 1:
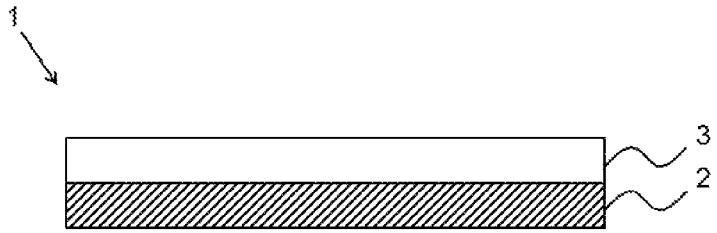
FIG. 1 a cross-sectional view of an embodiment of a thread (contact thread) for contacting an electroconductive paper structure.

The following description is directed in particular to the first, second and third aspect of the invention described in clauses 1 to 14 in the summary of the invention.

The present invention is based on the idea of providing an electroconductive paper structure with improved contacting, in analogy to a security thread incorporated in a bank note paper, by embedding continuous, electroconductive contact threads in the electroconductive paper structure. The electroconductive paper structure is thus traversed from one end to the opposite end by the continuous, conductive contact threads. This enables an easy contacting of the electroconductive paper structure at the ends of the contact threads and by the incorporation of the contact threads over the entire area of the paper structure represents a local current supply to all regions of the paper structure.

Expediently, in the electroconductive paper structure there is present a plurality of continuous, electroconductive threads for contacting the electroconductive paper structure, which are each embedded from one end to the opposite end of the paper structure, wherein the plurality preferably assumes a value in the region of two to eight, more preferably a value in the region of two to six, and particularly preferably the value two.

The electroconductive paper structure according to the invention can be manufactured e.g. by means of a conventional cylinder technology. In this way, it is basically possible to process varying fiber compositions. It is expedient to admix conductive, metallic shortcut fibers to the cellulosic fibrous materials. The metallic shortcut fibers typically have a fiber length in the region of 3 to 12 mm. The quantity in which the conductive, metallic shortcut fibers are admixed is expediently selected such that sufficient fiber-to-fiber contacts are given and thus a suitable electrical current flow is guaranteed. The electroconductive paper structure may contain further natural and/or synthetic fiber materials, where applicable chemical additives and where applicable residual moisture. Furthermore, electrical conductivity can be achieved not only by conductive metallic fibers, in particular metallic shortcut fibers, but also by adding carbon fibers, carbon particles or carbon nanotubes.

The cylinder technology enables a continuous, conductive thread to be embedded into the core of the electroconductive paper structure so that the electroconductive paper structure is transversed by the continuous, conductive thread from one end to the opposite end. The continuous, conductive thread embedded in the electroconductive paper structure in this way thus represents a contact thread. As used herein, the term "contact thread" is understood to be a thread for contacting the electroconductive paper structure, which is conductively connected within the electroconductive paper structure at many places directly to the conductive, metallic (shortcut) fibers, carbon fibers, carbon particles and/or carbon nanotubes contained therein. The contact thread embedded in the electroconductive paper structure according to the invention is, with regard to its arrangement in the paper, comparable to a security thread embedded in a bank note paper. Expediently, not only one continuous, conductive thread is incorporated in the electroconductive paper structure, but advantageously a plurality of continuous, conductive threads is incorporated in the electroconductive paper structure. On the one hand, the contact threads enable an easy contacting at the ends of the threads and, on the other hand, establish a local current supply to all regions by being incorporated over the entire area of the electroconductive paper structure. The contact threads thus fulfil a double function in a particularly advantageous way. The electroconductive paper structure according to the invention furnished with contact threads is further characterized by its robustness and long-term stability.

The cellulosic fibrous materials usable for the electroconductive paper structure according to the invention can be selected e.g. from fibrous materials of natural origin or from synthetic fibrous materials. Cellulosic fibrous materials of natural origin comprise e.g. wood fibers, semipulps, thermomechanical pulp, cotton fibers, chemically decomposed cellulose such as sulphate pulp or sulphite pulp, wood pulp, chemically modified wood pulp, recycled fibrous materials and combinations of two or several of the foregoing elements.

Conductive materials, in particular conductive fibers, such as metallic (shortcut) fibers, graphitized carbon fibers (herein also referred to simply as "carbon fibers") or metallized plastic fibers, and/or conductive particles, such as carbon particles, carbon nanotubes or fullerenes, are added to the cellulosic fibrous materials. For example, the proportion of metallic shortcut fibers which are admixed with regard to the cellulosic fibrous materials may vary depending on the application, in particular in a region from a few weight percent (wt %) to 50 wt % or more. Expediently, so many conductive fibers are admixed that the so-called percolation threshold is exceeded in order to ensure sufficient conductivity. Therefore, a sufficient network of conductive fibers is necessary so that the electrical current flow is guaranteed.

Furthermore, in particular carbon fibers can be admixed to the cellulosic fibrous materials as conductive materials. Carbon fibers are preferably understood to be industrially produced fibers formed from carbon-containing material and converted, e.g. by pyrolysis, into a graphite-like carbon arrangement. Such fibers can be produced isotropically or anisotropically and usually have a diameter in a region of 5 μm to 8 μm. During processing, these individual fibers are combined into bundles (roving) with 1000 to 400,000 individual fibers and can then be processed further. Carbon fibers are good conductors both electrically and thermally. Moreover, carbon fibers are understood to be fibrous materials from a group comprising high-strength carbon fibers, high modulus carbon fibers and/or high-strength carbon fibers. The carbon fibers usable according to the invention may have a preferred length distribution or a corresponding center of mass, which preferably lies in a region from 1 μm to 50,000 μm, e.g. in a region from 8000 μm to 50,000 μm, in particular in a region from 1 μm to 8000 μm and more preferably in a region from 5000 μm to 8000 μm. This length distribution is advantageous both when employing primary carbon fibers and recycled carbon fibers, as it allows the corresponding carbon fibers to be mixed well and in particular homogeneously with the other cellulosic fibrous materials of the mixture for manufacturing the paper structure. In particular, the aim here is to guarantee the most homogeneous distribution possible of the at least two fibrous material constituents both in the suspension for manufacturing a paper structure and in the paper structure itself. According to another particularly preferred embodiment of the present invention, the proportion of carbon fibers in the paper structure (under controlled climatic conditions of 23° C. and 50% relative humidity) is greater than 35 wt %. It should also be taken into account here that as the proportion of primary and/or recycled carbon fibers increases, the specific resistance of the paper structure formed therefrom may possibly decrease and the conductivity of the paper thus formed may increase. Advantages of an increased proportion of carbon fibers in the paper structure are, but are not limited to, improved conductivity, the reduction of electrical resistance in the sheet or paper structure and the higher power consumption associated therewith. The increased employment of carbon fibers can be achieved by the selected fiber length distribution of the carbon fibers and/or by the combination with the paper fibrous material. This can be, for example, cotton fiber material, which is fibrillated in a targeted manner, in particular by means of targeted grinding (Hollander grinding), and can thus provide a particularly high strength potential for the paper structure to be produced. The specific resistance of the paper structure according to the invention is e.g. in the region of $10^{-2}$ Ωm to $10^{-5}$ Ωm.

Chemical additives may be added to the electroconductive paper structure according to the invention, where applicable, which are selected e.g. from a group comprising in particular retention agents, dewatering aids, retention agent dual systems or microparticle systems, wet- and dry-strength agents, sizing agents, fillers, and/or pigments in particular selected from a group of talc, titanium dioxide, aluminium hydroxide, bentonite, barium sulphate, calcium carbonate, kaolin, and defoamers, deaerators, biocides, enzymes, bleaching aids, optical brighteners, dyes, nuance dyes, catcher of disturbing components, precipitants (fixing agents), wetting agents, pH regulators. Alternatively or in combination, the chemical additive can also be selected from a group of preferably water-soluble polymers, which comprises in particular amine-containing polymers, polyethyleneimine, pyrolidine, polyamides, polyacrylamide, aridine, proteins, peptides, polyether-containing polymers, in particular polyethylene oxide, polyether, hydroxyl group-containing polymers, in particular starch, carboxymethyl cellulose, polyvinyl alcohol, charged polymers, in particular cationic polymers, in particular cationic starch, corn starch, potato starch, wheat starch, rice starch, ammonium group-containing polymers, anionic polymers, in particular anionically modified polyacrylamides, sulphonated polymers, inorganic salts with high charge density, in particular aluminium salts, aluminium(III) chlorides, aluminium sulphate, sodium aluminate, inorganic charged particles/pigments, in particular bentonite, montmorillonite, sodium silicate, wet strength agents, in particular epichlorohydrin resins, glyoxal, zirconium salts, zirconium carbonate, combination of anionic polymers and cationically modified pigments, auxiliary agents for reducing the flash point, combinations thereof and the like.

According to a further particularly preferred embodiment, the paper structure according to the invention has a weight per unit area according to DIN EN ISO 536 which is in a region from 15 g/m$^2$ to 1000 g/m$^2$, preferably in a region from 20 g/m$^2$ to 300 g/m$^2$.

The paper structure according to the invention further has e.g. a power consumption which is in the region from 50 W/m$^2$ to 5000 W/m$^2$. Here, a temperature in the region from 15° C. to 130° C. can be achieved on the surface of the paper structure, for example.

The electroconductive paper structure according to the invention can be furnished with additional reinforcing fibers for controlling the desired properties. In addition, surface sizing or surface impregnation is possible.

With regard to the contact threads, different designs are conceivable. It is important in all designs to ensure contact with the conductive components located in the paper structure, in particular metallic fibers and/or carbon fibers. In the simplest case, a metallic thread, e.g. of rolled metal, a metal band or a metal wire can be used as the contact thread, the metal being selected in particular from a highly conductive metal such as silver, copper, gold, aluminium, tungsten, iron or the like or an alloy of one or several of the aforementioned elements. Furthermore, however, the use of a metallized thread is also possible, e.g. the use of a thread based on a plastic carrier foil as a carrier substrate and metallized with a highly conductive metal such as silver, copper, gold, aluminium, tungsten, iron or the like. As a plastic carrier foil in particular polyethylene terephthalate (PET) can be used. Furthermore, as a contact thread a metallized foil or a laminate of foils and rolled metal foils can be used. A particularly reliable contacting by means of crimp contacts or ZIF connectors (ZIF=Zero Insertion Force) is conceivable with purely metallic threads which are designed as a metal band, e.g. with a width in a region of 2 to 5 mm. An increased metal thickness improves the durable contact. For a better fixation of the contact thread in the electroconductive paper structure, metallized threads of this type can be additionally equipped, at least on one side, with an adhesive, which is advantageously a conductive adhesive. Furthermore, it is possible that the contact thread embedded in the electroconductive paper structure is partially exposed in the region of the contacting point, as is the case with so-called window threads in bank notes.

Furthermore, the contact threads can additionally be furnished with a protective layer or protective foil on the upper side, which is removed as required in the contacting region, i.e. in the window region.

The term contact thread is not necessarily limited to the sole configuration as a (rather narrow) thread, which e.g. has a width of 2 mm or less, but configurations such as (rather wide) strips or bands are also conceivable, which have e.g. a width of 4 mm to 20 mm, or even a width of up to 30 mm. Basically, it is also conceivable that a simple conductive metal wire or a metal braiding is used as a contact thread. Design variants such as flat strands, plait braiding, knitted fabrics, tinsel bands and the like are also possible. The thickness of the contact thread can be selected e.g. in a region from 10 to 300 μm, preferably in a region from 10 to 200 μm, more preferably in a region from 10 to 100 μm and particularly preferably in a region from 10 to 50 μm.

The electroconductive paper structure according to the invention can additionally be printed with a conductive pattern of conductor paths in order to reduce in this way the distances between two (or a plurality greater than two) contact threads serving as electrodes. The printing, i.e. the provision of the printed conductor paths, can be effected for example by means of a screen printing method. As conductive lacquers that produce the conductive pattern there can be used e.g. aqueous screen printing inks based on carbon black particles, silver particles or other particles establishing the conductivity. The conductive pattern of printed conductive paths is expediently produced in such a pattern that the distances between two electrodes is approximately similar in all regions. According to a preferred variant, the contacting of the conductive pattern to the contact threads embedded in the substrate can be effected such that the contacting is effected via the places (so-called thread windows) at which the contact threads are partially exposed. The measure of additionally printing with a conductive pattern has the effect that the product can be operated with relatively low voltages as a conductive areal element. Due to the reduced distance between two electrodes, even with a small number of conductive fibers in the substrate a current necessary for the respective application, e.g. a heater, can be achieved. Alternatively, with the same number of conductive fibers in the substrate, a desired current can already be achieved with a lower voltage. By suitably adjusting the dimension of the conductive fibers and of the printed conductive pattern, even the percolation threshold can be lowered. The latter describes the minimum proportion of conductive fibers required to achieve a fiber network conductive throughout between two contact threads serving as electrodes and thus a relevant current flow. This results in cost savings with regard to the cost-intensive conductive fibers. A lower operating voltage has the additional effect that the effort is reduced, e.g. for the driving electronics, and increases occupational safety.

The present invention further comprises a method for manufacturing an electroconductive paper structure. As a method for this a cylinder technology is employed which is known from the field of bank note paper manufacturing, see e.g. EP 0 279 880 A1 and EP 0 492 407 A1. In cylinder machines, the thread is introduced into the pulp and brought toward the cylinder sieve in such a way that the thread is embedded in the fiber construction during sheet formation. In doing so, the thread can be completely embedded in the paper structure so that the thread is not visible to the viewer, neither from the front nor from the back. However, the thread can also be embedded such that it is freely accessible on one side after embedding in the paper structure. This is possible e.g. by mechanically removing, in particular by suctioning, the paper layer deposited on one side of the thread. However, the formation of freely accessible regions on at least one side of the embedded thread can also be achieved in that the width of the thread is selected sufficiently high, see e.g. EP 0 625 431 A1. Furthermore, the thread can be embedded in the paper structure such that the thread is exposed at its surface at least at one place of the paper structure in order to form a so-called window thread. The manufacturing of window security threads is known in the field of bank note paper manufacturing, see e.g. EP 0 059 056 A1. The thread is brought toward the paper-making screen, outside the pulp, such that the thread comes to rest on raised places (or bumps) applied to the paper-making screen. At the places at which the thread rests on the bumps, no paper can form on the side facing the screen, so that the thread is freely accessible precisely at these places in the later finished paper.

The method for manufacturing the electroconductive paper structure according to the invention can further be effected by assembling the paper structure from two separate paper plies and arranging the thread between these paper webs. Such a manufacturing is known from the manufacturing of bank note paper having embedded security thread, see e.g. EP 0 229 645 A1.

A preferred method for manufacturing the electroconductive paper structure according to the invention comprises in particular the following steps:

- The provision of a stock suspension made of cellulosic fibrous material and water.
- The addition of at least one chemical additive, where applicable.
- The addition of the electroconductive material, in particular electroconductive fibers such as carbon fibers.
- The introduction of a continuous, electroconductive thread into the stock suspension located in a cylinder paper machine, wherein the thread is brought toward the cylinder sieve such that during the sheet formation an embedding of the thread into the fiber construction is effected.

The dewatering is effected by draining the water into the interior of the cylinder sieve.

The invention further comprises the use of the electroconductive paper structure as a heating element, in particular as a heating element in floors, walls, wallpapers, containers, fabrics, clothing, table tops, heating plates, heating mats, car interior heaters, in particular door, seat or dashboard heaters, the use for electromagnetic shielding and the use as an element for signal detection.

The following description is directed in particular to the fourth aspect of the invention described in clause 15 in the summary of the invention (not falling within the scope of the appended claims). The paper structure according to the fourth aspect of the invention (clause 15) represents, compared to the paper structure according to the first aspect of the invention (clause 1), a separate, alternative solution according to the invention. Here, the electroconductive paper structure consists substantially of cellulosic fibrous material, wherein the paper structure has embedded therein a continuous, electroconductive thread for contacting the paper structure from one end to the opposite end of the paper structure, wherein the thread is embedded in the paper structure such that the thread is partially exposed at its surface at several places of the paper structure, wherein the paper structure is printed with a conductive pattern of conductive paths such that the contacting of the conductive pattern to the thread embedded in the paper structure is effected via the places at which the thread is partially exposed.

The wording "consisting substantially of cellulosic fibrous material" means that the paper structure may further contain, in addition to cellulosic fibers, additives or stabilizers or the like (e.g. fillers such as titanium dioxide, detergents, surfactants or the like), but electroconductive fibers are not present. The paper structure according to the fourth aspect of the invention implements a partial, structured and low-cost conductivity. According to a preferred embodiment, the paper structure has embedded therein two or more continuous, electroconductive threads for contacting the paper structure from one end to the opposite end of the paper structure, wherein the threads are embedded in the paper structure such that each thread is partially exposed at its surface at several places of the paper structure, wherein the paper structure is printed with a conductive pattern of conductive paths such that the contacting of the conductive pattern to the threads embedded in the paper structure is effected via the places at which the threads are partially exposed. In particular, the paper structure may have embedded therein a plurality of continuous, electroconductive threads for contacting the paper structure from one end to the opposite end of the paper structure, wherein the plurality preferably assumes a value in the region of two to eight, further preferably a value in the region of two to six, and particularly preferably the value two.

FIGS. 1 to 8 relate in particular to the first, second and third aspect of the invention described in clauses 1 to 14 in the summary of the invention.

FIG. 1 shows a cross-sectional view of an embodiment of a thread 1 (contact thread) for contacting an electroconductive paper structure. The thread 1 to be incorporated into an electroconductive paper structure is initially present in the form of e.g. an endless thread wound onto a spool, and is based on a carrier substrate 2, in the example polyethylene terephthalate (PET), which is coated on its surface with a conductive metal 3, e.g. copper or silver. The thread 1 has a width of 3 mm and a thickness of 50 μm.

Figure 2:
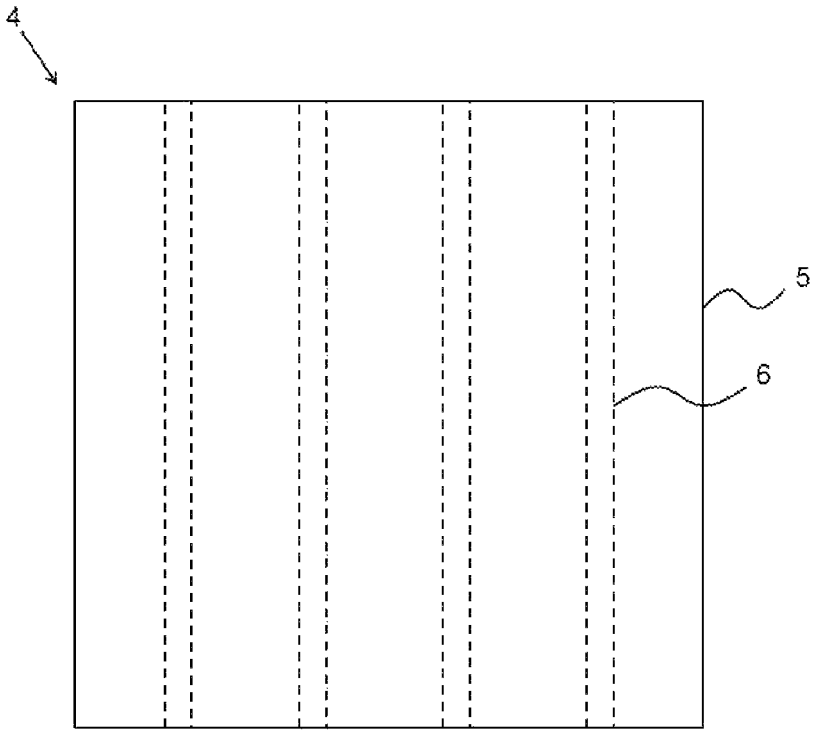
FIG. 2 in plan view, a first embodiment of an electroconductive paper structure according to the invention with contact threads fully embedded therein.

FIG. 2 shows in plan view a first embodiment of an electroconductive paper structure 4 according to the invention with four separate contact threads 6 completely embedded in the paper structure. The contact threads 6 have the construction shown in FIG. 1 above. The electroconductive paper structure 4 is based on a mixture containing paper fibrous material and metallic shortcut fibers. The contact threads 6 were completely embedded in the paper ply 5 by means of a cylinder paper machine, as shown in particular in FIG. 3 of EP 0 279 880 A1, so that the contact threads 6 are not visible to the viewer, neither from the front nor from the back of the electroconductive paper structure 4. It can be seen from FIG. 2 that the contact threads 6 traverse the electroconductive paper structure 4 from one end to the opposite end. The electroconductive paper structure 4 thus has excellent contacting at its two ends. The paper structure 4 shown in FIG. 2 has the form of a square sheet with four contact threads 6 embedded therein. The sheet can be cut to a format suitable for the user as desired. Moreover, the number of contact threads 6 present in the sheet cut to size can be freely selected. For example, the paper structure 4 can be cut to size such that four individual, strip-shaped, electroconductive paper structures are obtained, which respectively contain an embedded contact thread 6.

Figure 3:
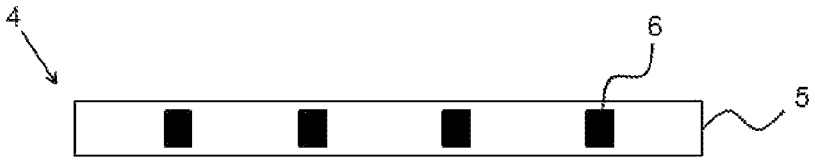
FIG. 3 the cross-sectional view of the electroconductive paper structure according to the first embodiment.

FIG. 3 shows the cross-sectional view of the electroconductive paper structure 4 according to the first embodiment. The contact threads 6 completely embedded in the electroconductive paper structure 4 are respectively arranged in the paper ply 5 such that the electroconductive metallization 3 shown in FIG. 1 is at the top and the PET carrier substrate 2 is at the bottom.

Figure 4:
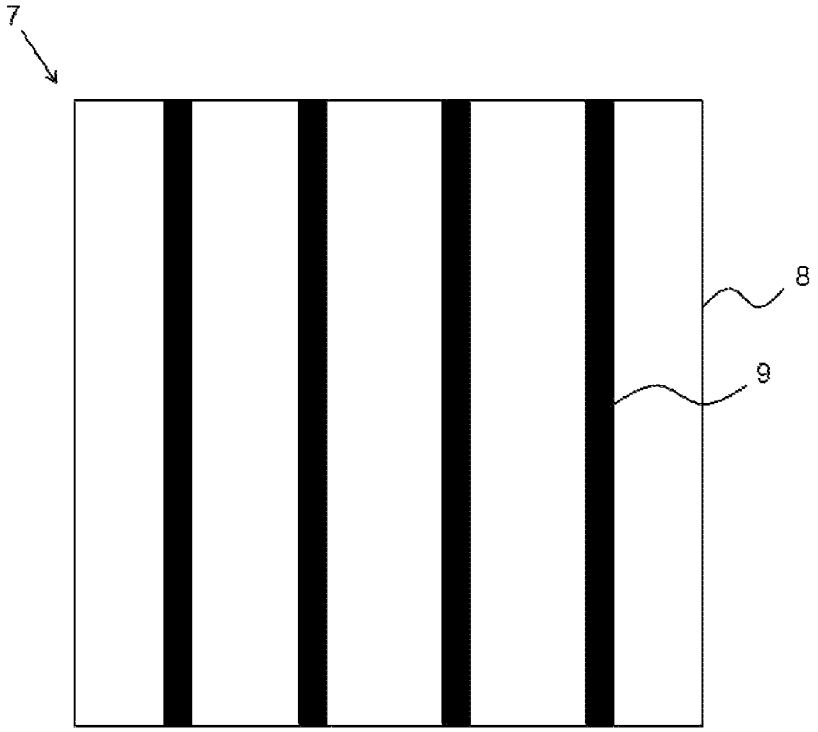
FIG. 4 in plan view, a second embodiment of an electroconductive paper structure according to the invention with embedded contact threads that are freely accessible on one side.

FIG. 4 shows in plan view a second embodiment example of an electroconductive paper structure 7 according to the invention with embedded contact threads 9 which are freely accessible on one side. The contact threads 9 have the construction shown in FIG. 1 above. The electroconductive paper structure 7 is based on a mixture containing paper fibrous material and carbon fibers. The contact threads 9 were embedded in the paper ply 8 by means of a cylinder paper machine so that the contact threads 9 are recognizable to the viewer from the front. This can be accomplished e.g. by using a suitable cylinder sieve that has suitable raised regions at the places that come into contact with the threads to be embedded. Alternatively, the production can be effected by means of mechanically removing, in particular suctioning, the paper layer deposited on one side of the thread. It can be seen from FIG. 4 that the contact threads 9 traverse the electroconductive paper structure 7 from one end to the opposite end. The electroconductive paper structure 7 thus has excellent contacting at its two ends. Because the contact threads 9 are freely accessible at the front of the paper structure 7, the electroconductive paper structure 7 can be contacted at its front at numerous locations.

Figure 5:
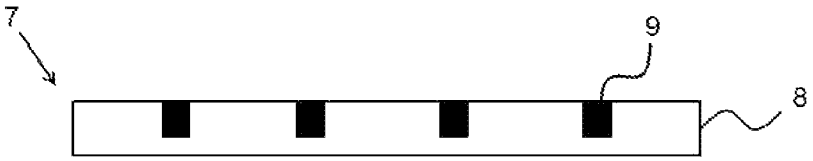
FIG. 5 a cross-sectional view of the electroconductive paper structure according to the second embodiment.

FIG. 5 shows the cross-sectional view of the electroconductive paper structure 7 according to the second embodiment. The contact threads 9 freely accessible at the front of the electroconductive paper structure 7 are respectively arranged in the paper ply 8 such that the electroconductive metallization 3 shown in FIG. 1 is at the top and the PET carrier substrate 2 is at the bottom.

Figure 6:
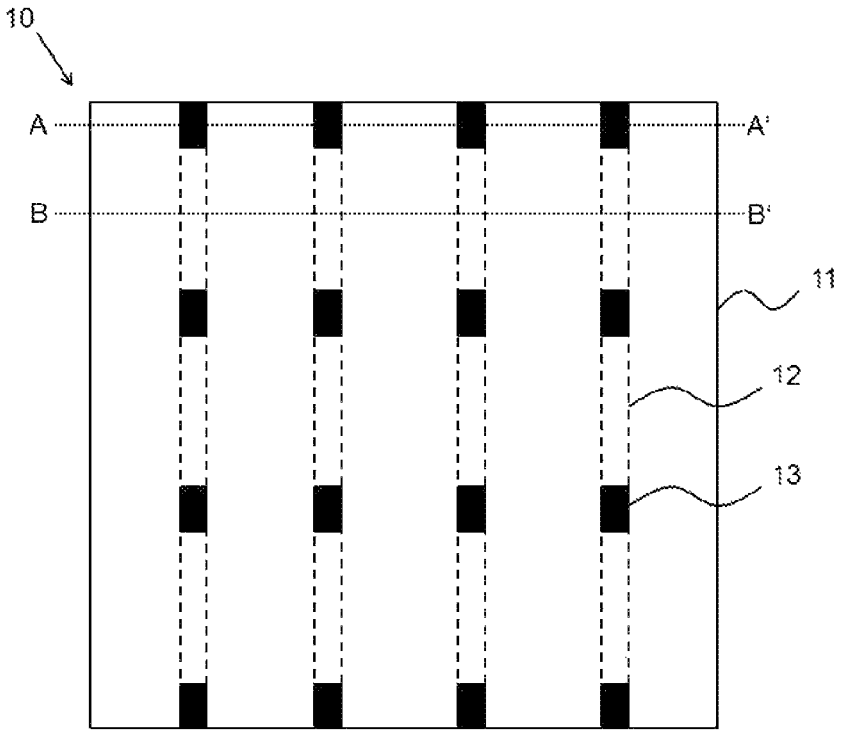
FIG. 6 in plan view, a third embodiment of an electroconductive paper structure according to the invention with contact threads embedded in the paper structure in the form of window threads.

FIG. 6 shows in plan view a third embodiment of an electroconductive paper structure 10 according to the invention with contact threads 12 embedded in the paper ply 11 in the form of window threads. The contact threads 12 embedded in the electroconductive paper structure 10 are freely accessible in certain regions 13 (so-called window regions). The electroconductive paper structure is based on a mixture containing paper fibrous material and metallic shortcut fibers. The contact threads 12 were embedded in the paper in a similar way to the method for manufacturing bank notes with window security threads known from EP 0 059 056 A1. The electroconductive paper structure 10 thus has excellent contacting at its two ends. As the contact threads 12 are freely accessible in the window regions 13, the front of the electroconductive paper structure 10 can also be contacted at these locations.

The cross-section along the imaginary line A-A' shown in FIG. 6 corresponds to the cross-section shown in FIG. 5.

The cross-section along the imaginary line B-B' shown in FIG. 6 corresponds to the cross-section shown in FIG. 3.

In the above embodiments, the contact thread was based on a plastic substrate coated with a conductive metal. Instead of such a thread, a carrierless metallic thread could alternatively be used, so that the PET carrier substrate 2 shown in FIG. 1 is omitted. Such a carrierless metallic thread has, compared to a plastic substrate coated with conductive metal, better electrical conductivity. In particular threads based on (thinly) rolled, conductive metal are advantageous.

In further embodiments which follow the above embodiment, a wire made of conductive metal is used as the contact thread.

Figure 7:
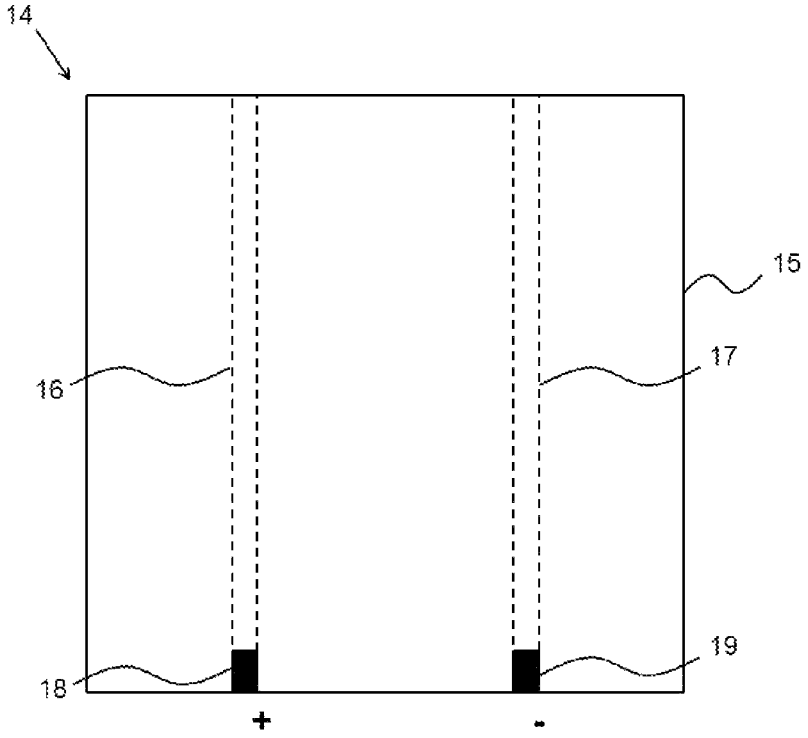
FIG. 7 in plan view, a fourth embodiment of an electroconductive paper structure according to the invention with two contact threads embedded in the paper structure.

FIG. 7 shows in plan view a fourth embodiment of an electroconductive paper structure 14 according to the invention with two contact threads 16 and 17, which are completely embedded in the paper ply 15 with the exception of two places 18 and 19. The contact threads 16 and 17 embedded in the electroconductive paper structure 14 are freely accessible in the regions 18 and 19 at which the contacting to the current source is effected. The signs "+" and "–" in FIG. 7 indicate the positive pole and negative pole of the current source, respectively.

Figure 8:
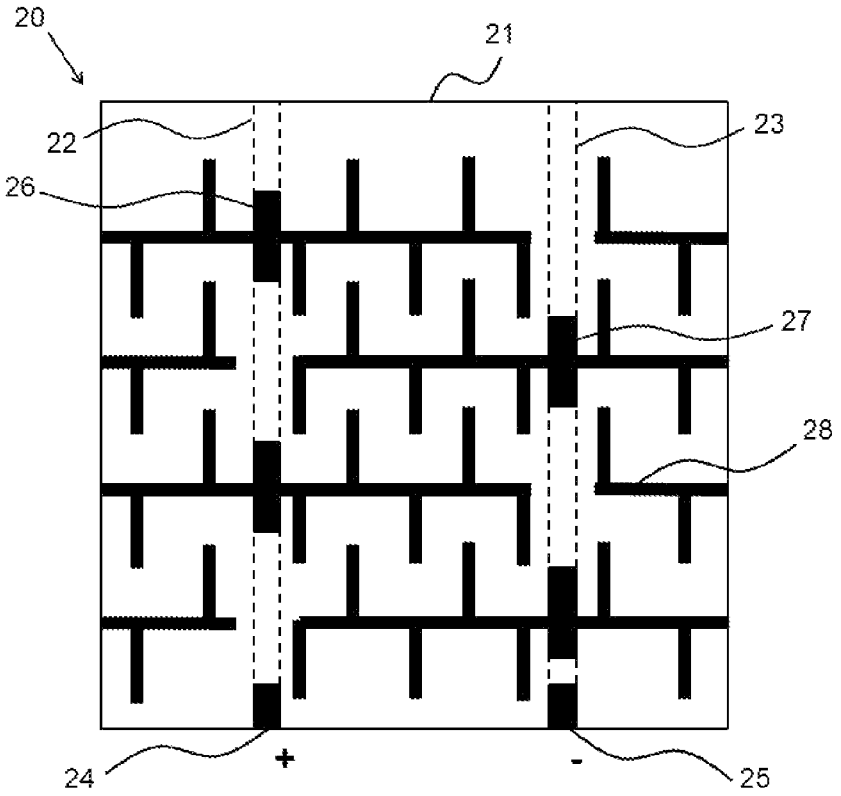
FIG. 8 in plan view, a fifth embodiment of an electroconductive paper structure according to the invention with two contact threads which are respectively embedded in the paper structure in the form of window threads, wherein the electroconductive paper structure is additionally printed with a conductive pattern

FIG. 8 shows in plan view a fifth embodiment of an electroconductive paper structure 20 according to the invention with two contact threads 22 and 23 which are respectively embedded in the paper structure 21 in the form of window threads, wherein the electroconductive paper structure 21 is additionally printed with a conductive pattern 28. In this way, the distance between the two contact threads 22 and 23 serving as electrodes is reduced. The contact threads 22 and 23 embedded in the electroconductive paper structure 21 are freely accessible in the regions 24 and 25 at which the contacting to the current source is effected. The signs "+" and "–" in FIG. 8 indicate the positive pole and negative pole of the current source, respectively. The contact threads 22 and 23, which are respectively embedded in the paper structure 21 in the form of window threads, are furthermore constituted such that they are partially exposed at the surface at several places (see e.g. reference numbers 26 and 27) of the paper structure (so-called thread windows). Contacting of the contact threads 22 and 23 with the additionally printed conductive pattern 28 is effected via the thread windows. The printing was effected by means of a screen printing method aqueous screen-printing ink based on silver particles served as a conductive lacquer producing the conductive pattern 28. The conductive pattern 28 is expediently present in such a pattern that the distances between the two electrodes 22 and 23 is approximately similar in all regions. The measure of additionally printing with the conductive pattern 28 has the effect that the product can be operated with relatively low voltages as a conductive areal element.

A further embodiment (which does not fall within the scope of protection of the appended claims) which is not illustrated in the Figures relates to the fourth aspect of the invention described in clause 15 in the summary of the invention. Here, the paper structure is similar to the paper structure shown in FIG. 8, with the paper merely containing cellulosic fibrous materials, i.e. electroconductive fibers are not present in this case. Additives or stabilizers or the like may be contained therein where applicable, e.g. fillers such as titanium dioxide, detergents, surfactants or the like. The paper structure has embedded therein two (or more) continuous, electroconductive threads for contacting the paper structure from one end to the opposite end of the paper structure, wherein the threads are embedded in the paper structure such that each thread is partially exposed at its surface at several places of the paper structure, wherein the paper structure is printed with a conductive pattern of conductive paths such that the contacting of the conductive pattern to the threads embedded in the paper structure is effected via the places at which the threads are partially exposed.

The invention claimed is:

1. An electroconductive paper structure, comprising:

at least one electroconductive paper ply with cellulosic fibrous materials and electroconductive fibers, and a plurality of continuous, electroconductive threads embedded in and surrounded on at least three sides by the electroconductive paper ply for contacting the electroconductive paper structure from one end to the opposite end of the paper structure to provide a current to the electroconductive paper ply;

wherein the electroconductive paper structure is a heating element.

2. The electroconductive paper structure according to claim 1, wherein the plurality of continuous, electroconductive threads for contacting the electroconductive paper structure from one end to the opposite end of the paper structure assumes a value in the range of two to eight.

3. The electroconductive paper structure according to claim 1, wherein the electroconductive fibers are metallic fibers and/or carbon fibers.

4. The electroconductive paper structure according to claim 1, wherein the electroconductive paper structure contains additional electroconductive materials, wherein the additional electroconductive materials are carbon particles and/or carbon nanotubes.

5. The electroconductive paper structure according to claim 1, wherein the plurality of continuous, electroconductive threads for contacting the electroconductive paper structure is a metal wire, a metal thread, a metal band, a thread based on a carrier substrate such as a plastic foil and coated with a metal, a laminate of (plastic) foils and metal foils, a metal braiding, a plait braiding, a knitted fabric or a tinsel wire.

6. The electroconductive paper structure according to claim 1, wherein the paper structure is based on a single paper ply in which the plurality of continuous, electroconductive threads is embedded for contacting the electroconductive paper structure.

7. The electroconductive paper structure according to claim 1, wherein the paper structure is based on two separate paper plies between which the plurality of continuous, electroconductive threads is arranged for contacting the electroconductive paper structure.

8. The electroconductive paper structure according to claim 1, wherein the plurality of continuous, electroconductive threads for contacting the electroconductive paper structure is completely embedded in the paper ply so that the plurality of continuous, electroconductive threads is not visible to the viewer, neither from the front nor from the back; or the plurality of continuous, electroconductive threads is embedded in the paper ply such that the plurality of continuous, electroconductive threads is present in the paper structure in a manner freely accessible on one side; or the plurality of continuous, electroconductive threads is embedded in the paper ply such that the plurality of continuous, electroconductive threads is partially exposed on its surface at least at one place of the paper structure.

9. The electroconductive paper structure according to claim 1, wherein the electroconductive paper structure additionally has chemical additives and residual moisture.

10. The electroconductive paper structure according to claim 1, wherein the electroconductive paper structure is additionally-printed with a conductive pattern of conductor paths.

11. The electroconductive paper structure according claim 10, wherein the electroconductive paper ply has embedded therein two or more continuous, electroconductive threads for contacting the electroconductive paper structure from one end to the opposite end of the paper structure, wherein the threads are respectively embedded in the paper ply such that each thread is partially exposed on its surface at several places of the paper structure, wherein the electroconductive paper structure is printed with the conductive pattern of conductive paths such that the contacting of the conductive pattern to the threads embedded in the paper ply is effected via the places at which the threads are partially exposed.

12. A method for manufacturing an electroconductive paper structure according to claim 1, comprising:

providing a stock suspension made of cellulosic fibrous material and water;

adding at least one chemical additive, where applicable;

adding electroconductive fibers;

introducing at least one continuous, electroconductive thread into the stock suspension located in a cylinder paper machine, wherein the thread is brought toward the cylinder sieve such that during the sheet formation or during the formation of the paper web an embedding of the thread into the fiber construction is effected.

13. The method according to claim 12, wherein the paper structure is formed such that it is composed of two separate paper plies and the thread is arranged between these paper plies.

14. The electroconductive paper structure according to claim 1, wherein the plurality of continuous, electroconductive threads establishes a local current supply to at least a region of the electroconductive paper structure.

15. The electroconductive paper structure according to claim 1, wherein the plurality of continuous, electroconductive threads is embedded in and in at least one region entirely surrounded by the electroconductive paper ply.

16. An electroconductive paper structure, comprising:

at least one electroconductive paper ply with cellulosic fibrous materials and electroconductive fibers, and a plurality of continuous, electroconductive threads are embedded in and surrounded on at least three sides by the electroconductive paper ply for contacting the electroconductive paper structure from one end to the opposite end of the paper structure to provide a current to the electroconductive paper ply;

wherein the electroconductive paper structure is additionally printed with a conductive pattern of conductor paths that have one or more bends;

wherein the electroconductive paper structure is a heating element.

* * * * *